United States Patent [19]

Itoh

[11] 4,228,961

[45] Oct. 21, 1980

[54] ELECTROSTATIC POWER PAINTING HEAD

[75] Inventor: Tsutomu Itoh, Tokyo, Japan

[73] Assignee: Onoda Cement Co., Ltd., Onoda, Japan

[21] Appl. No.: 36,282

[22] Filed: May 7, 1979

[51] Int. Cl.[3] ..... B05B 5/02

[52] U.S. Cl. ..... 239/698; 239/707; 239/105; 361/226

[58] Field of Search ..... 239/690–708, 239/3, 105; 361/218, 226, 227

[56] References Cited

U.S. PATENT DOCUMENTS 3,698,635 10/1972 Sickles ..... 239/3

4,011,991 3/1977 Masuda ..... 361/227 X

FOREIGN PATENT DOCUMENTS 990149 4/1965 United Kingdom ..... 239/698

*Primary Examiner*—Robert W. Saifer

*Attorney, Agent, or Firm*—Price, Heneveld, Huizenga & Cooper

[57] ABSTRACT

An electrostatic powder painting gun head in which a needle electrode is provided at a central portion in the proximity of a cylindrical powder ejection port made of insulator, an annular strip electrode is disposed outside of the powder ejection port, also a gas injection port for forming a gas flow layer along the surface of the annular strip electrode is provided, and further there is provided a high voltage power supply for applying a predetermined voltage between the needle electrode and the annular strip electrode. Powder ejected from the powder ejection port can be surely charged by making all the ejected powder cross with a monopolar corona discharge current flowing from the needle electrode towards the annular strip electrode, the powder can be deposited even onto a concave portion of a body to be painted without generating a Faraday cage effect, and also accumulation of charged powder paint particles onto the surface of the annular strip electrode disposed outside of the powder ejection port can be prevented.

8 Claims, 11 Drawing Figures

ELECTROSTATIC POWER PAINTING HEAD

Figure 1:
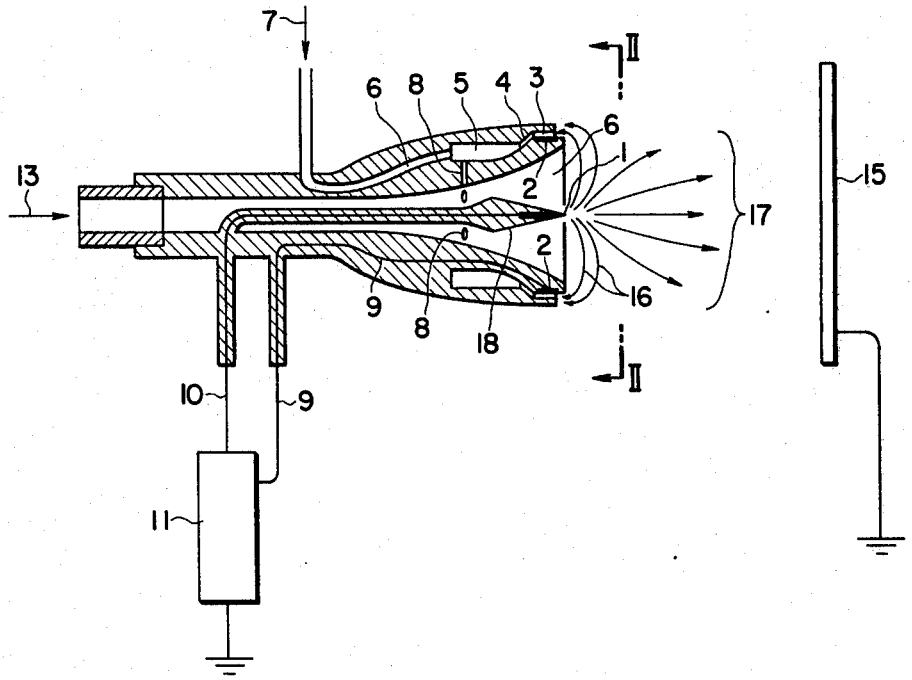

The present invention relates to improvements in an electrostatic powder painting gun head that is available upon electrostatically applying powder paint onto a body to be painted.

More particularly, the present invention relates to a gun head for use in electrostatic powder painting in which a corona discharge electrode is provided in the proximity of a powder ejection port, and on the outside of said powder ejection port is provided another electrode having a potential difference with respect to first said corona discharge electrode and associated with means for preventing powder from depositing onto said another electrode, whereby an extremely high painting efficiency can be attained in a normal mode of operation, while an excellent overall covering capability can be realized even in a recessed or corner portion by suppressing an influence of a Faraday cage effect in another mode of operation.

An electrostatic powder painting process has become employed more and more in recent years because of absence of public nuisances caused thereby and an excellent property of a painted film formed thereby. However, there exist very big causes which prevent a more general use of the process. A first one of the causes is a low transfer efficiency of the powder paint, and the second is the so-called Faraday cage effect, the latter being a well-known disadvantage of the process that depositing powder onto a recessed portion of a body to be painted is very difficult.

One object of the present invention is to surely charge the powder ejected from a powder ejection port by making all said powder cross with a mono-polar corona discharge current flowing across a tip end of a gun head and thereby attain an extremely high painting efficiency for a body to be painted.

In order to maintain the mono-polar corona current from the needle electrode to the annular strip electrode, a gas flow layer is formed along the surface of the strip electrode preventing charged powder paint particles from accumulating on a surface of a strip electrode provided outside of a powder ejection port.

Yet another object of the present invention is to surely apply powder paint even onto an inside surface of a recess in a body to be painted without generating a Faraday cage effect.

The aforementioned objects of the present invention can be achieved by providing an electrostatic powder painting head which comprises a cylindrical powder ejection port made of insulator, a needle electrode disposed in the proximity of said powder ejection port, an annular strip electrode disposed outside of said powder ejection port, and a gas ejection port for forming a gas flow layer along the surface of said strip electrode, a predetermined voltage being applied between said needle electrode and said annular strip electrode.

Figure 2:
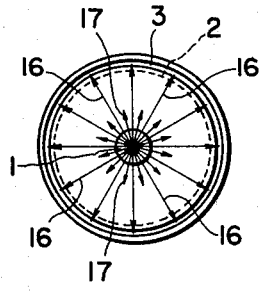
Figure 4:
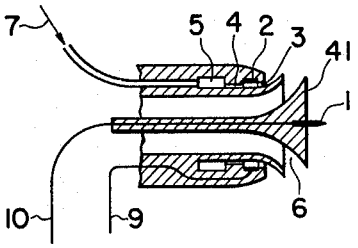
Figure 5:
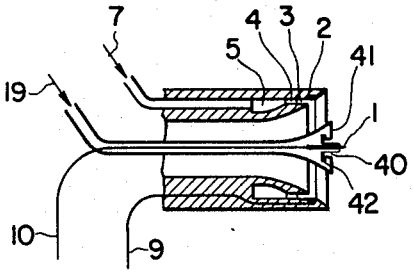
Figure 6:
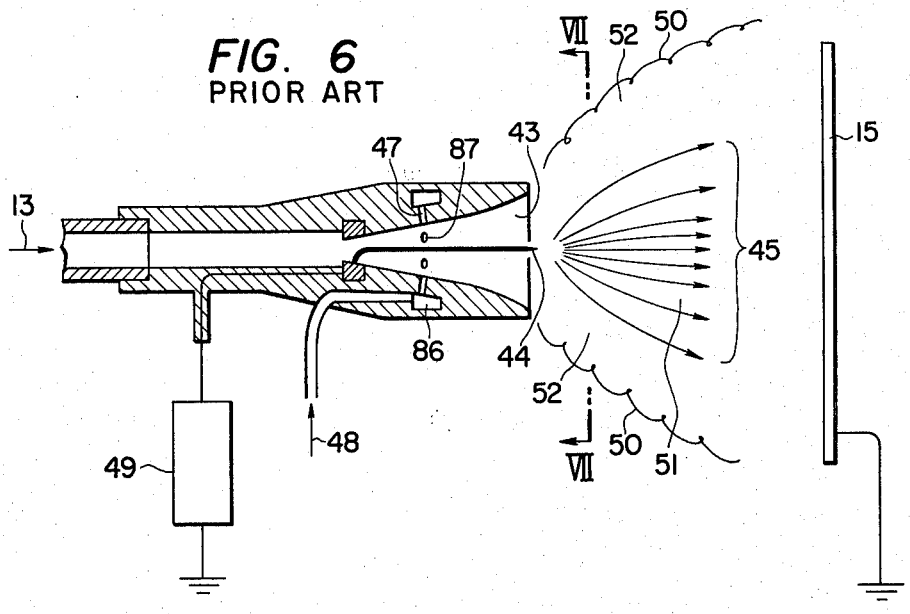
FIG. 6 PRIOR ART
Figure 7:
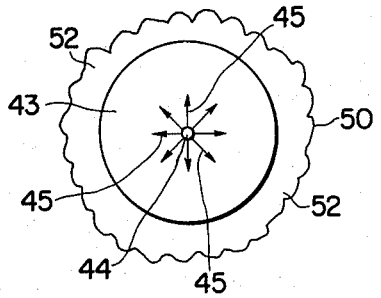
FIG. 7 PRIOR ART
Figure 9:
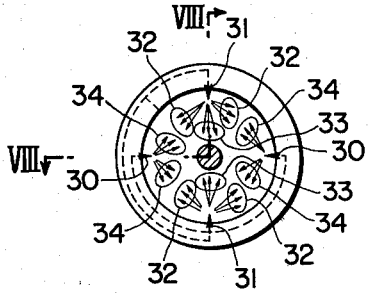
FIG. 9 PRIOR ART
Figure 8:
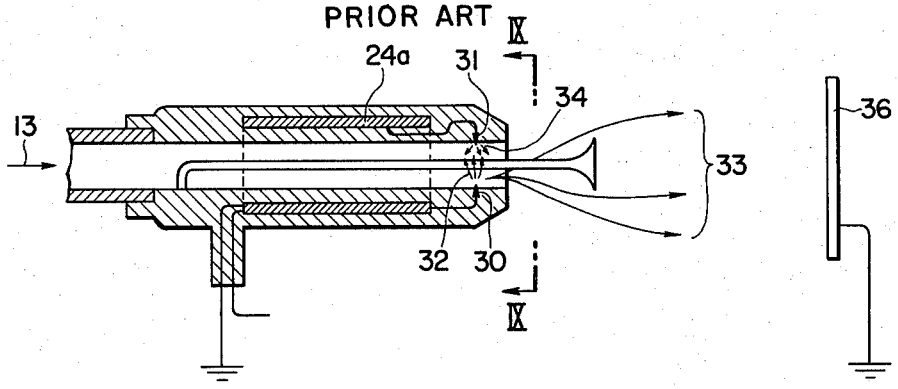
FIG. 8 PRIOR ART
Figure 10:
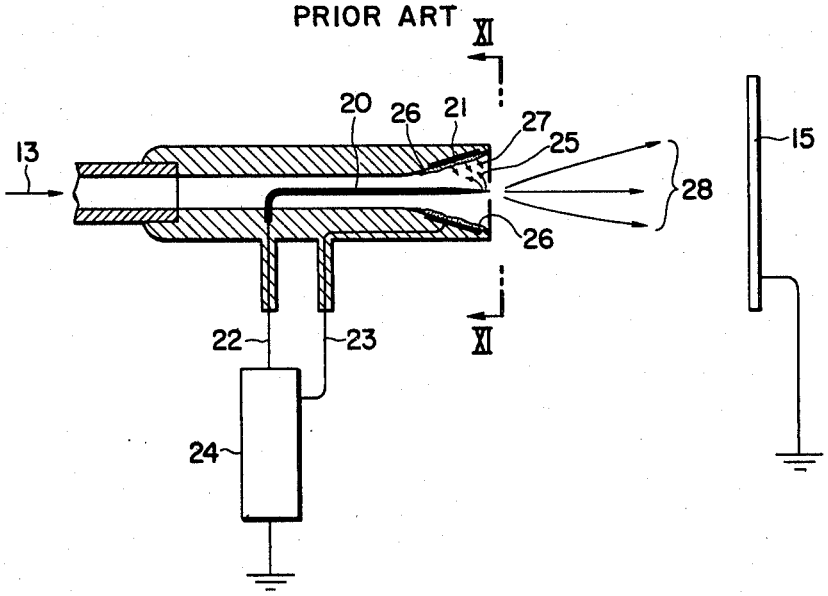
FIG. 10 PRIOR ART
Figure 11:
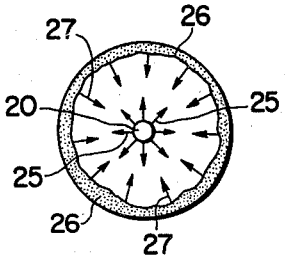
FIG. 11 PRIOR ART

The above-described disadvantages of the electrostatic powder painting head in the prior art as well as the above-mentioned and other objects and features of the present invention will be better understood from the following specification taken in conjunction with the accompanying drawings, in which:

FIG. 1 is a longitudinal cross-section view showing an electrostatic powder painting gun head according to one preferred embodiment of the present invention, FIG. 2 is a side view taken along line II—II in FIG. 1, FIGS. 3, 4 and 5, respectively, are partial longitudinal cross-section views of other preferred embodiments of the present invention, FIG. 6 is a longitudinal cross-section view of one example of the electrostatic powder painting gun heads in the prior art, FIG. 7 is a side view taken along line VII—VII in FIG. 6, FIG. 8 is a longitudinal cross-section view of another example of the prior art heads taken along line VIII—VIII in FIG. 9 as viewed in the direction of arrows, FIG. 9 is a side view taken along line IX—IX in FIG. 8, FIG. 10 is a longitudinal cross-section view of still another example of the prior art gun heads, and FIG. 11 is a side view taken along line XI—XI in FIG. 10.

A transfer efficiency obtained in the case where a flat body to be painted is painted by making use of an electrostatic powder painting gun as shown in FIG. 6 which is widely used at present, is the highest efficiency among practically achievable painting efficiencies in electrostatic powder painting. Even in such a favorable case, normally only a transfer efficiency of about 65–85% can be attained, and in practice, the remainder 35–15% of the expensive powder paint is compelled to be wasted, especially in the case where color mixing of recovered paint is extremely undesirable as is the case with finish painting of a car body. The causes for the fact that the transfer efficiency of the electrostatic powder gun of the type illustrated in FIG. 6 is limited to about 65–85%, are generally classified into the following two principal causes. The first cause is that charging of powder is effected under a condition where an ion current flows in parallel to a powder flow forming a thick layer extending in the space between a powder ejection port and a body to be painted, accordingly the ion current cannot fully penetrate through an entire powder cloud as inhibited by a small amount of well charged powder cloud portion existing in the proximity of the powder ejection port, so that charging of the powder effected by the ion current becomes insufficient, and especially in the case where an ejection rate of the powder is large and a powder concentration is high, the charging of the powder becomes insufficient, resulting in lowering of the transfer efficiency. The second cause is that an extension of an ion current and an electric field for painting is small as compared to an extension of an ejection pattern of powder, so that once powder particles have come to a peripheral portion of an ejected powder cloud they have no more chance of being charged, and also they are not deposited onto a body to be painted because the electric field is weak and thus eventually disperse away.

More particularly, as shown in FIG. 6, in a currently widely used electrostatic powder gun, powder paint 13 suspended in a supplied air is moderately ejected from a tip end portion 43 of the gun towards a body to be painted as carried by a carrier air flow while forming a well dispersed powder cloud 52 by means of, for example, a swirl air flow shown at 47 or a deflection device. In FIGS. 6 and 7, lines 50 represent a boundary of a region where the powder cloud 52 ejected from the tip end of the gun mainly exist. On the other hand, a high voltage is applied by means of a high voltage power supply 49 to a needle electrode 44 disposed at the tip end of the powder ejection head, and as a result, a corona discharge current and lines of electric force as shown by arrows 45 arise from the tip end of the needle electrode 44, which lines of electric force terminate principally on a body 15 to be painted. It is to be noted that FIG. 7 is a side view taken along line VII—VII in FIG. 6, and in these figures the corona discharge current and the lines of electric force are represented by arrows 45.

As will be seen from FIG. 6, the corona discharge current 45 and the ejected powder flow obviously form parallel flows. As a result, since powder particles which were not charged upon passing through the proximity of the tip end of the needle are also moved by the action of the ejected air flow towards the body to be painted, the corona current does not penetrate through the uncharged powder portion due to the masking effect of a well charged powder portion, after all the uncharged powder particles have no chance of being charged until they reach the body 15 to be painted, and hence they are dispersed as carried by the air flow striking against the body to be painted, resulting in lowering of a transfer efficiency. This is basically caused by the fact that in a very thick space 51 that is normally of several to several tens centimeters in thickness and located between the tip end of the needle electrode 44 and the body 15 to be painted where a masking effect against the charging of powder is liable to occur, the powder flow carried by a carrier air and the corona discharge current form parallel flows, and especially in the central portion where a powder concentration is apt to become high, when a powder ejection rate is large, the loweing of the transfer efficiency is remarkable. On the other hand, in most case the powder is ejected while spreading over a considerably wide region as encircled by lines 50, whereas the generation source of the corona discharge current is limited to only one point at the tip end of the needle electrode 44, so that powder particles ejected to the peripheral portion 52 of the powder cloud have no chance of being charged, are dispersed by an air flow within a booth to locations other than the body to be painted because of a weak electric field in the peripheral portion 52, and hence this becomes a cause for the lowering of the transfer efficiency. In addition, although a number of modified methods are known in which an extremely high voltage is applied to the needle electrode or a plurality of needle electrodes are provided for the purpose of generating a sufficiently large charging corona current, in these modified cases as a result of the fact that a large amount of waste current flows into a body to be painted, there occurs a disadvantage that remarkable inverse ionization occurs in the deposited paint powder layer and hence a flat painted film is hardly obtained.

As an electrostatic powder gun having a different structure from that shown in FIG. 6 which has been widely used and is provided with a different electrode structure, an electrostatic powder gun illustrated in FIGS. 8 and 9 is known. It is to be noted that FIG. 9 is an enlarged side view taken along line IX—IX in FIG. 8. More particularly, in this type of electrostatic powder gun, at a tip end portion of a main body of the gun consisting of an insulator cylinder, are disposed about 2 pairs of needle electrodes having a potential difference of several thousands volts therebetween as shown at 30 and 31, to one electrode of each electrode pair is applied the highest voltage of a D.C. high voltage power supply **24*a* assembled integrally in the gun main body, to the other electrode is applied a voltage that is several thousands volts lower than the highest voltage, ions are produced at the tip end portion of the gun by continuously effecting a spark discharge between the electrodes in the respective pairs through a guard resistor, and thereby a stable corona discharge current is made to flow from the tip end of the gun towards a body 36 to be painted. In the case of such type of electrostatic powder gun, although at a glance it seems that an ion current flows in a crossed relation to a paint powder flow passing through a gun main body represented by arrow 13, practically in this case between each pair of electrodes 30 and 31 a current having the same polarity as the polarity of the power supply 24*a* flows out of the electrode 30 having a higher voltage applied thereto, for instance, in the case that the power supply 24*a* is a power supply for generating a negative high voltage, then mainly negative ions flow from the electrode 30 towards the electrode 31 as shown by arrow 34, whereas an opposite polarity of current flows out of the electrode 31, for instance, in the assumed case a positive ion current flows out of the electrode 31 towards the electrode 30, and as a result of the fact that positive and negative currents cross with a powder particle flown in such a narrow space, the powder particles passing through the space would have their electric charge fully removed, and therefore, it cannot be expected at all to charge powder particles with the ion currents flowing directly between these electrodes. The mechanism of charging powder particles in such type of gun is such that owing to a D.C. electric field established between the electrode 30 at the tip end of the gun and the body 36 to be painted, only a fraction of the negative ion current flowing from the electrode 30 towards the electrode 31 can flow towards the body 36 to be painted as shown by arrows 33, and consequently, in practice only the powder particles ejected from the tip end of the gun can be charged by the ion current 33** withdrawn out of the gun, which current flows in parallel to the powder flow.

Accordingly, such type of electrostatic powder guns are essentially not different at all from the type of electrostatic powder guns shown in FIG. 6 with respect to the charging mechanism for powder particles, although the former has an advantage that since a corona discharge can be surely generated between the pair of needle electrodes 30 and 31 at its tip end even by making use of a relatively low power supply voltage, the charging of the particles can be achieved in a relatively reliable manner by drawing a large current from the gun. It is to be noted that FIG. 9 shows in detail how electric currents flow from the two pairs of electrodes illustrated in the longitudinal cross-section view in FIG. 8, as viewed in a side view. Accordingly, in this type of electrostatic powder painting gun also, in the case of performing the painting with a widely expanded powder flow, the gun cannot be free from the disadvantage of the type of electrostatic powder gun shown in FIG. 6 that charging of the powder particles coming to the peripheral portion becomes insufficient and charging of the powder particles flowing along the central portion is also insufficient. It is to be noted that in the above description, a safety device associated with a power supply for preventing generation of a spark discharge, a feed device of the powder and the like were all omitted.

The inventor of this invention now provides a quite novel electrostatic powder gun of new type, which basically improves the disadvantages of the heretofore widely used electrostatic powder guns as described in detail above, and which can achieve a high painting efficiency and, if necesssary, can overcome a Faraday cage effect.

FIG. 1 is a longitudinal cross-section view of a head portion of an electrostatic powder gun according to the present invention, and FIG. 2 is a side view taken along line II—II in FIG. 1. The most essential structural feature of the electrostatic powder gun according to the present invention exists in that paint powder carried by a gas supplied into the powder gun as shown by arrow 13 is ejected moderately from the tip portion of the gun towards a body 15 to be painted owing to an appropriate pattern regulating device for powder that is provided at the tip end portion of the head, then at a center portion of a powder ejection port 6 is disposed a needle electrode 1 which is applied with a D.C. high voltage from a power supply 11 through a lead wire 10, in addition, a narrow strip-shaped annular electrode 2 having no sharp protrusion or edge (hereinafter called simply "strip electrode") is disposed outside of the powder ejection port 6, a clean gas containing no pulverized dust as shown by arrow 7 is fed to the surface of this strip electrode 2 through an annular chamber 5 and a flow mode regulating chamber 4, and the clean gas is adapted to be formed into a clean gas flow along the surface of the strip electrode 2 owing to a narrow space 3 provided on the surface of the strip electrode 2. It is to be noted that this strip electrode is connected via a lead wire 9 to a tap position at an appropriate potential of a power supply 11, and normally it is adapted to be applied with a potential about several thousands volts to thirty thousand volts lower than the potential of the needle electrode 1. Accordingly, in the case where such an electrode arrangement and a grounded body 15 to be painted are disposed in an opposed relationship, a monopolar corona discharge current 17 flowing from the tip end of the needle electrode 1 towards the body 15 to be painted as well as similar lines of electric force are established, and at the same time another monopolar corona discharge current flows from the tip end of the needle electrode 1 towards the strip electrode 2 so as to surely traverse the flow of powder, as shown by arrows 16. Such a state is especially apparent from the side view in FIG. 2, and owing to such an arrangement, a strong monopolar corona discharge current flows while surely traversing the powder flow ejected through the powder ejection port 6 of the gun head. As a result, into whatever configuration the pattern of powder ejected from the gun head may be regulated, the powder can be intensely charged by a monopolar traversing corona discharge current which is surely established in the region of the powder flow. The establishment of the monopolar traversing corona discharge current is the essential distinction of the present invention from the heretofore known type of powder guns which rely upon the charging by means of a parallel ion current as described previously.

In addition, although not illustrated in FIG. 1, a fairly intense electric field is also established surely from the strip electrode 2 towards the body 15 to be painted, so that the powder charged intensely by the monopolar traversing corona discharge current 16 can be surely captured within the region delimited by the electric field directed from the needle electrode 1 towards the body 15 to be painted and the electric field directed from the strip electrode 2 towards the body 15 to be painted, owing to these electric fields, and accordingly, almost all of the ejected powder is strongly sucked towards the body 15 to be painted, whereby stable painting is made possible.

As described above, in the electrostatic powder gun head according to the present invention, the establishment of an intense monopolar corona discharge current which can surely traverse all the powder flow ejected from the gun head, forms the most important feature of the present invention, and in order to reliably realize such a state in a gun head for powder painting that is available as an industrial device, it is necessary that the strip electrode 2 is disposed outside of the powder ejection port 6 as shown in FIG. 1 and a flow of a clean gas containing no powder is formed along the surface of the strip electrode 2 as described above. Now the reasons for such requirements will be explained in more detail. That is, since an intense monopolar corona discharge current 16 as shown in FIG. 1 is drawn as a result of the fact that the strip electrode 2 is held at a lower D.C. potential than the needle electrode 1 and a strong electric field is established between these electrodes, in the case where this flow of clean gas is not provided, very strongly charged powder particles would rapidly accumulate on the surface of the strip electrode 2. The internal electric field within the accumulated powder layer would become extremely strong, resulting in inverse ionization within the powder layer. Due to this inverse ionization, another strong monopolar current of the opposite polarity to that of the aforementioned monopolar corona discharge current would flow out of the surface of the strip electrode 2 and the electric charge carried on the powder particles charged by the current represented by arrows 16 would be neutralized by the current caused by the inverse ionization. Thus the charging capability of the electrode 2 would be entirely lost, and therefore, the desired object would not be achieved. Therefore, the inventor of this invention has found as a result of various efforts for investigation that the desired object can be first achieved by providing a strip electrode 2 outside of a powder ejection port 6 and also forming a flow of clean gas to such extent that accumulation of charged paint powder particles on the surface of the strip electrode 2 can be always prevented reliably, and thus the inventor has completed the subject invention.

Next, the reasons why the strip electrode 2 must be disposed outside of the powder ejection port 6 will be described in greater detail.

For instance, in the case shown in FIG. 10 where a strip electrode 21 is disposed inside of a powder ejection port at a tip end of a gun head as opposed to a tip end of a needle electrode 20, the highest voltage is applied from a power supply 24 to the needle electrode 20 through a lead wire 22, and a voltage somewhat lower than the highest voltage is applied to the inside strip electrode 21 through a lead wire 23, then since the flow velocity of the powder flow at the tip end of the powder ejection port which serves as a gun head cannot be raised so high, if it is tried to make a monopolar current 25 flow across the powder flow ejected from the gun head, then strongly charged paint powder particles will immediately accumulate on the surface of the strip electrode 21 as indicated by a powder layer 26, due to inverse ionization generated within the powder layer 26 a current having an opposite polarity flows out of the layer 26 intensely towards the needle electrode 20, which current entirely offsets the monopolar charging effect of the first monopolar current 25, and immediately it becomes impossible to give an electric charge to the powder in this region. Therefore, in this case the provision of the strip electrode 21 as opposed to the tip end of the needle electrode 20 does not play any effective role, and hence the desired object cannot be achieved. This is solely due to the fact that the ejection flow velocity of powder at the powder ejection port of a gun cannot be chosen fast, and so, it is quite impossible to enhance a painting efficiency of a gun head by means of an opposite electrode provided inside of the powder ejection port.

Whereas, in the case shown in FIG. 1 where the strip electrode 2 is provided outside of the gun head, this portion is located outside of the powder ejection port of the gun, also the flow path 3 formed outside of the strip electrode 2 can be made extremely narrow, normally to the extent of 0.5 mm or less, and even if a clean gas is made to flow through this path 3 at a considerable flow velocity, the patter of powder particles ejected from the tip end of the gun is not influenced thereby, so that the surface of the strip electrode 2 can be always maintained clean. Since charged particles never accumulate on the surface of the strip electrode 2, only the monopolar corona discharge current 16 flows from the needle electrode 1 towards the strip electrode 2, and thereby it is made possible to surely effect charging of paint powder passing through this region. Furthermore, by regulating the mode of the clean gas flow ejecting through the gap space 3 with an appropriately shaped flow mode regulating device 4 (a device for regulating a flow rate, flow pattern and direction of flow) so that the clean gas may be ejected while swirling to keep the surface of the strip electrode clean, it is possible to make the clean air flow effectively act upon the regulation of the ejection pattern of the powder achieved, for example, by a swirl groove 8 or the like provided inside of the powder ejection port of the gun, and in this way, the present invention has been accomplished by the two characteristic features of disposing a strip electrode 2 outside of a powder ejection port 2 and also providing a flow of clean gas along its surface. Moreover, according to the present invention, since the monopolar corona discharge current 17 flowing from the tip end of the needle electrode 1 towards the body 15 to be painted is always present as is the case with the conventional gun head, the deposited powder layer formed on the body 15 to be painted is well charged and very rigid. It is to be noted that the regulation of the ejected powder pattern at the powder ejection port is not limited solely to a swirl flow, but in the embodiment shown in FIG. 1, a deflection device 18 associated with the needle electrode 1 is also jointly used for the regulation of the ejected powder pattern.

As explained in detail above, in the powder painting gun head according to the present invention, since all the powder ejected from the powder ejection port is certainly charged by a strong monopolar corona discharge current flowing across the tip end of the gun while traversing the powder flow, and since there exist both the strong electric field penetrating through the inner portion of the cloud of the ejected powder up to the body to be painted and the strong field emanating from the strip electrode and terminating always at the body to be painted while enclosing the cloud of the ejected powder, an extremely high transfer efficiency can be obtained. Although the painting efficiency will vary depending upon the operating conditions of the gun, that is, the ejection rate of powder and the properties of powder paint such as, for example, grain size and configuration, electric resistance, dielectric constant, etc., normally the powder gun according to the present invention can provide about 10% to 15% higher painting efficiency as compared to the best condition of the conventional powder gun operating at the same ejection rate for the same body to be painted. More particularly, in the case where the body to be painted has a relatively flat shape and a large size, a painting efficiency of about 90 to 95% can be surely obtained, and this is the first of the most important advantages of the powder painting gun head according to the present invention.

In addition, the second of the most important advantages of the powder painting gun head is that a Faraday cage effect can be obviated to a considerable extent, and even when a considerable degree of recesses or corner portions are present in the body to be painted, the powder can be surely deposited to the inside of the recesses or corners. More particularly, in contrast to the fact that in the case where it is intended to obtain a high transfer efficiency for a relatively flat body to be painted according to the present invention, the voltage applied to the tip end of the needle electrode should be selected at a high value, while a voltage somewhat lower than that applied to the needle electrode 1 should be applied to the strip electrode 2, and thereby the electric field extending from the needle electrode 1 and the strip electrode 2 towards the body 15 to be painted should be strengthened; in the case where recesses or corners are present in the body 15 to be painted, it is desirable to regulate the voltages applied from the power supply 11 through the lead wires 10 and 9, respectively to the needle electrode 1 and the strip electrode 2 so that the voltage applied to the needle electrode 1 may be selected at a relatively low value, while the potential difference applied between the needle electrode 1 and the strip electrode 2 may not be reduced to a so small value. By making such regulation, the electric field extending from the respective electrodes towards the body 15 to be painted can be made very weak without varying the magnitude of the monopolar corona discharge current 16 flowing from the needle electrode 1 to the strip electrode 2 at all, and therefore, despite of the fact that almost no electric field exists between the body 15 to be painted and the gun head, the powder ejected from the gun can be charged very strongly. Accordingly, under the above-described regulated condition of the electric field, by blowing the pattern of powder ejected from the powder ejection port onto the body 15 to be painted without so much broadening the powder flow, the very strongly charged powder can be blown even into the recesses in the body to be painted without Faraday cage effect, and thereby the paint powder can be surely deposited even onto the inner surfaces of the recessed portions. This is the second of the most important advantages of the powder painting gun head according to the present invention.

Further it is to be noted that since the voltages applied to the needle electrode 1 and the strip electrode 2 according to the present invention can be obtained by dividing a voltage supplied from the same power supply, the power supply is not complexed at all by increasing the number of electrodes, and the apparatus itself can be constructed in a less expensive manner. Moreover, the above-proposed operation mode for painting the body 15 to be painted while obviating a Faraday cage effect is applicable not only to the case of avoiding a Faraday cage effect but also to the case where a relatively unaccessible portion for powder or a remote portion is painted from a distant gun, and thus the applicable scope of the electrostatic powder painting head according to the present invention is very wide. Still further, in the case of employing the powder gun in the form of an automatic gun or a hand gun, the combination of voltages applied from the power supply to the gun is made selectable either automatically or by means of a manual switch button of a hand gun, and thus the mode of application of voltages is automatically or manually selected among two or more modes depending upon the objects to which the powder gun is to be applied, in such manner that when it is desired to paint a flat portion at a high painting efficiency, a first operation mode may be realized in which while generally high voltages are applied to the both electrodes, a monopolar ion current may be obtained between the respective electrodes in a sufficient magnitude, whereas when it is required to operate the gun while placing a substantial importance to the uniform painting onto the recesses or the like, generally low voltages are applied to the respective electrodes while sustaining a strong monopolar corona discharge current flowing from the needle electrode 1 to the strip electrode 2. Thereby, the most appropriate operating condition for a given object to be painted can be selected, and thus the overall efficiency of powder painting can be further enhanced. This is the third of the most important advantages of the present invention.

Figure 3:
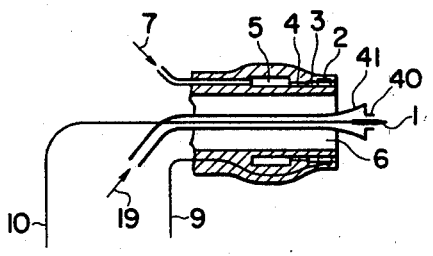

The electrostatic powder painting head according to the present invention is essentially characterized by the fact that a needle electrode 1 is disposed inside of an ejection port of powder, whereas a strip electrode 2 is disposed outside of the powder ejection port, an appropriate potential difference is maintained between these electrodes, and a flow of clean gas is formed along the surface of the strip electrode 2, and provided that the aforementioned characterizing conditions are fulfilled, an extremely wide scope of modification can be made depending upon a configuration of a body 15 to be painted, paint and a painting condition. FIGS. 3, 4 and 5 illustrate some examples of such modification.

FIG. 3 shows such type of modification that at the powder ejection port, regulation of the powder pattern is effected by means of a deflection device 41, and in this modified embodiment a clean gas flow is ejected around the needle electrode 1 through a blast pipe 40 as shown by arrow 19 for the purpose of assuring stability of a performance upon a long-run operation. In addition, with regard to a strip electrode 2, this figure shows an embodiment in which the strip electrode 2 is disposed outside of a flow 3 of clean gas that is formed outside of a powder ejection port 6 differring from the arrangement shown in FIG. 1. Thus the present invention is not always limited to the arrangement in which a strip electrode 2 is attached on the outside of an outer cylinder directly surrounding a powder ejection port 6 as shown in FIG. 1. In FIG. 3, arrow 7 represents a clean gas fed into this gun head for the purpose of forming a flow of clean gas along the surface of the strip electrode 2, and this clean gas is passed through an annular chamber 5 and a flow mode (rate and pattern of gas flow) regulating groove 4 to form a flow of clean gas through a narrow space 3. It is to be noted that reference numerals 10 and 9 designate lead wires for applying predetermined voltages to the needle electrode 1 and the strip electrode 2, respectively, and in this figure the connection to a power supply is omitted. It is also to be noted that in FIGS. 1, 2, 3, 4 and 5, component parts having the same capability are represented by a common reference numeral.

In FIG. 4 is shown another example of modification, in which a deflection device 41 disposed at the tip end portion of a powder ejection port has a solid structure with a needle electrode 1 disposed at its center and a high voltage is applied to the needle electrode 1 through a lead wire 10. While the structure of the strip electrode 2 is essentially similar to that shown in FIG. 3, in order to regulate the pattern of a powder cloud ejected from a powder ejection port 6 having an annular transverse cross-section the tip end of the powder ejection port 6 is formed in an outwardly flared shape somewhat projecting forwardly. Even in such a configuration, if an appropriate voltage is applied to the strip electrode 2 through a lead wire 9, then a strong monopolar corona discharge current can be surely drawn from the needle electrode 1 towards the strip electrode 2 as traversing a powder cloud ejected through the powder ejection port 6 of annular cross-section, and thereby the object of the present invention can be fully achieved.

In still another modified embodiment illustrated in FIG. 5, a deflection device 41 has a hollow structure adapted to eject a clean gas through a cylindrical blast pipe 40 formed around a needle electrode 1 that is disposed at the tip end of the deflection device 41, and in this case within the hollow deflection device 41 are provided gas introduction ports 42 for introducing a clean gas into the blast pipe 40 in the circumferential direction thereof to thereby prevent the powder from accumulating on the surface of the deflection device 41 opposed to the object to be painted. In addition, in the arrangement shown in FIG. 5, the strip electrode 2 disposed outside of the powder ejection port is located outside of a flow 3 of clean gas likewise to the arrangement in FIG. 4, and a tip end of a cylinder encircling the flow 3 of clean gas is somewhat extended forwardly to smoothly form a pattern of a powder cloud. With regard to the position where the strip electrode 2 is to be disposed, it should be selected within the range where an effective action of the flow of clean gas can surely extend to the surface of the strip electrode, and basically it is desirable to dispose the strip electrode at a position where the electrode 2 is not directly exposed to the lines of flow of the ejected powder as shown in FIGS. 3 and 4, although exceptionally, for example in the arrangement as shown in FIG. 5, the foremost end of the strip electrode 2 on the ejection port side could slightly extend to the outside of the flow of clean gas. In the case of the arrangement shown in FIG. 5, if the flow of clean gas is directly ejected in parallel to the axis of the powder ejection port, then it would disturb the flow of the powder cloud that is gradually expanding, and therefore, sometimes it is desirable to make a provision such that the ejected flow of clean gas may flow along the outwardly flared surface of the powder ejection port by employing a swirl groove or the like as the flow mode regulating groove 4.

In the case of the powder painting head of the type employing a deflection device as shown in FIGS. 3, 4 and 5, the number of the needle electrode 1 to be disposed at the front end of the deflection device is not limited to one, but if necessary, a plurality of needle electrodes could be employed without departing the sprit of the present invention. In addition, the extension and the like of the powder flow can be regulated by adjusting the axial direction of the deflection device. Otherwise, the regulation of the powder pattern can be effected by making use of a swirl flow introduced in the circumferential direction at a location just before the powder ejection port, and according to such a method, an appropriate ejection pattern of powder can be obtained by ejecting a flow of clean gas as it is swirling along a flow mode regulating groove 4. In addition, with regard to the positions where the ejection pattern regulating device and the strip electrode 2 are to be disposed, the different modes of selecting the respective positions as shown in FIGS. 1, 2, 3, 4 and 5 could be combined in various ways to construct an appropriate device depending upon a given object, and with respect to the method for regulating the ejection pattern and the relative arrangement of the needle electrode and the strip electrode not shown in these figures also, various changes and modifications could be made so long as they do not depart from the basic principle of the present invention.

While description was omitted in the above specification, upon application of high voltages to the needle electrode and the strip electrode it is necessary to provide well-known countermeasures for safety such as disposing a guard resistor just before each electrode, or automatically lowering or blocking a power supply voltage when an excessive current flows, for the purpose of preventing dangerous sparks from occurring due to accidental approach or contact of a body being painted to the powder gun head.

Although the ejection port of powder should preferably have a circular cross-section in most cases, if necessary, a powder ejection port having a flat cross-section shape or a cross-section shape consisting of a plurality of connected circles could be employed, and according to the shape of the powder ejection port, a plurality of needle electrodes could be disposed in multiple and the shape of the strip electrode could be chosen in a flat loop shape or other shapes without being limited to the illustrated annular shape.

Since many changes could be made in the above construction and many apparently widely different embodiments of this invention could be made without departing the scope thereof, it is intended that all the matter contained in the above description or shown in the accompanying drawings shall be interpreted as illustrative and not as a limitation to the scope of the invention.

What is claimed is:

1. An electrostatic powder painting head characterized in that said head comprises a powder ejection port made of insulator, a needle electrode disposed in the proximity of said powder ejection port, a strip electrode disposed outside of said powder ejection port, and a gas ejection port for forming a gas flow layer along the surface of said strip electrode, and a predetermined voltage is applied between said needle electrode and said strip electrode.

2. An electrostatic powder painting head as claimed in claim 1, characterized in that said powder ejection port is formed in a cylindrical shape or in an outwardly flared cone shape, and said strip electrode is formed in an annular shape.

3. An electrostatic powder painting head as claimed in claim 1 or 2, characterized in that said needle electrode is associated with a blast pipe opening around the tip end of the electrode.

4. An electrostatic powder painting head as claimed in claim 2, characterized in that said powder ejection port is provided with a swirl groove opening in the circumferential direction on its inner surface.

5. An electrostatic powder painting head as claimed in either of claims 1 or 2, characterized in that a deflecting means for a powder flow is provided in said powder ejection port.

6. An electrostatic powder painting head as claimed in claim 4 further characterized in that said needle electrode is associated with a blast pipe opening around the tip of the electrode.

7. An electrostatic powder painting head as claimed in claim 4 further characterized in that a deflecting means for a powder flow is provided in said powder ejection port.

8. An electrostatic powder painting head as claimed in claim 1 further characterized in that said needle electrode is associated with a blast pipe opening around the tip end of the electrode; a deflecting means for a powder flow is provided in said powder ejection port.

* * * * *

UNITED STATES PATENT AND TRADEMARK OFFICE

CERTIFICATE OF CORRECTION

PATENT NO. : 4 228 961

DATED : October 21, 1980

INVENTOR(S) : Tsutomu Itoh

It is certified that error appears in the above—identified patent and that said Letters Patent is hereby corrected as shown below:

Title:

"Electrostatic Power Painting Head" should be

--Electrostatic Powder Painting Head--

Title used before Specification:

"Power" should be --Powder--

Column 3, line 32:

"loweing" should be --lowering--

Column 3, line 34:

"case" should be --cases--

Column 7, line 19:

"patter" should be --pattern--

Column 9, line 54:

"differring" should be --differing--

UNITED STATES PATENT AND TRADEMARK OFFICE

CERTIFICATE OF CORRECTION

PATENT NO. : 4 228 961

DATED : October 21, 1980

INVENTOR(S) : Tsutomu Itoh

It is certified that error appears in the above—identified patent and that said Letters Patent is hereby corrected as shown below:

Column 10, lines 67 and 68:

"departing the sprit" should be --departing from the spirit--

Signed and Sealed this

*Fifth* Day of *May 1981*

[SEAL]

*Attest:*

RENE D. TEGTMEYER

*Attesting Officer*

*Acting Commissioner of Patents and Trademarks*